United States Patent [19]

Bowater et al.

[11] Patent Number: 4,757,309

[45] Date of Patent: Jul. 12, 1988

[54] GRAPHICS DISPLAY TERMINAL AND METHOD OF STORING ALPHANUMERIC DATA THEREIN

[75] Inventors: Ronald J. Bowater, Romsey; Michael I. Davis, Winchester; Robert W. E. Farr; Colin V. Powell, both of Eastleigh, all of United Kingdom

[73] Assignee: International Business Machines Corporation, Armonk, N.Y.

[21] Appl. No.: 748,259

[22] Filed: Jun. 24, 1985

[30] Foreign Application Priority Data

Jun. 25, 1984 [EP] European Pat. Off. ..... 084304303.5

[51] Int. Cl.[4] ..... G09G 1/28

[52] U.S. Cl. ..... 340/703; 340/734; 340/747; 340/748

[58] Field of Search ..... 340/701, 703, 721, 734, 340/744, 745, 747, 748

[56] References Cited

U.S. PATENT DOCUMENTS

| | | | |
|---|---|---|---|
| 3,978,470 | 9/1976 | McGuire | 340/703 |
| 4,206,457 | 6/1980 | Weisbecker et al. | 340/799 |
| 4,408,200 | 10/1983 | Bradley | 340/703 |
| 4,470,042 | 9/1984 | Barnich et al. | 340/745 |
| 4,490,797 | 12/1984 | Staggs et al. | 340/721 |
| 4,491,832 | 1/1985 | Tanaka | 340/721 |
| 4,580,135 | 4/1986 | Kummer et al. | 340/703 |

FOREIGN PATENT DOCUMENTS

| | | |
|---|---|---|
| 2477745 | 3/1980 | France . |
| 8302509 | 7/1983 | World Int. Prop. O. . |
| 2098837 | 5/1982 | United Kingdom . |

*Primary Examiner*—Gerald L. Brigance
*Assistant Examiner*—Jeffery A. Brier
*Attorney, Agent, or Firm*—Frederick D. Poag; Robert L. Troike; J. Dennis Moore

[57] ABSTRACT

The specification describes a method of storing alphanumeric characters in a graphics display terminal comprising a raster-scan display device and a refresh buffer including a plurality of bit planes each having a respective bit storage location corresponding to each addressable pel position on the screen of the display device. In the method, a first bit plane stores high resolution luminance data defining alphanumeric characters each as a selection of "on" bits within a respective n×m array where n is the width of the character box in the scan line direction, and at least one further bit plane stores low resolution color data for the characters. The attribute plane comprises a respective n-bit set of storage locations which corresponds to each n-bit wide by one pel deep portion of a character box in the luminance plane and defines at least the color and/or intensity of the foreground and background of the character for the width of the character box in respect of a single scan line. The specification also describes a graphics display terminal in which data in the luminance and attribute planes may be selectively decoded either as alphanumeric data stored as above, or as bit-mapped graphics data.

3 Claims, 4 Drawing Sheets

Figure 1:
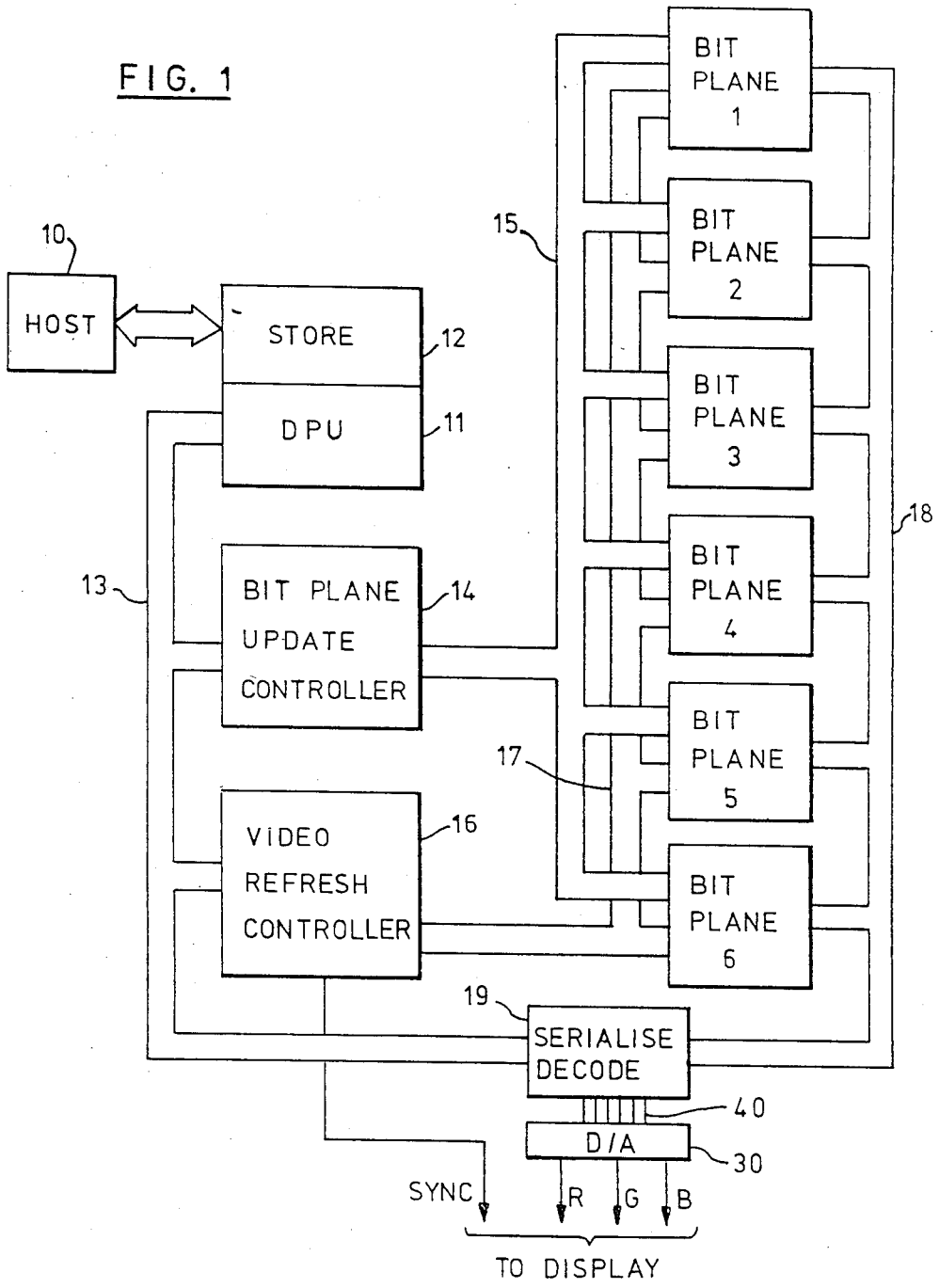

| CODE | F/B COLOUR | |
|---|---|---|
| 0 0 0 0 | BLACK | STEADY |
| 0 0 0 1 | GREEN | |
| 0 0 1 0 | BLUE | |
| 0 0 1 1 | CYAN | |
| 0 1 0 0 | RED | |
| 0 1 0 1 | YELLOW | |
| 0 1 1 0 | MAGENTA | |
| 0 1 1 1 | WHITE | |
| 1 0 0 0 | TRANSPARENT | |
| 1 0 0 1 | GREEN | BLINKING |
| 1 0 1 0 | BLUE | |
| 1 0 1 1 | CYAN | |
| 1 1 0 0 | RED | |
| 1 1 0 1 | YELLOW | |
| 1 1 1 0 | MAGENTA | |
| 1 1 1 1 | WHITE | |

FIG. 3

GATES
GATES
GATES
N
N
ENCODE
VIDEO LUT
TRANSPARENT
MODE SELECT
F/G DECODE & LATCH
B/G DECODE & LATCH
GATES
GATES
N
SER
SER
SER
SER
SER
SER
FROM BIT PLANE 1
FROM BIT PLANE 2
FROM BIT PLANE 3
FROM BIT PLANE 4
FROM BIT PLANE 5
FROM BIT PLANE 6
2/3 R
1/3 R
2/3 B
1/3 B
2/3 G
1/3 G
T1
T2

GRAPHICS DISPLAY TERMINAL AND METHOD OF STORING ALPHANUMERIC DATA THEREIN

FIELD OF THE INVENTION

This invention relates to a graphics display terminal of the kind comprising a raster-scan display device and a refresh buffer including a plurality of bit planes each having a respective bit storage location corresponding to each addressible pel position on the screen of the display device, the bit planes being addressed in coordination with the line-by-line scanning of the display device to provide multi-bit per pel output data defining the color and/or intensity of each pel on the screen. Such terminals are well known; see, for example, section 19.1 of the book "Principles of Interactive Computer Graphics" by Newman and Sproull, published 1981 by McGraw-Hill. The invention also relates to a method of storing alphanumeric data in such a terminal.

PRIOR ART

Applications of these terminals make it desirable to include alphanumerics (including special symbols) and graphics data types. Although this appears to require different display adapters in order to update the bit planes for each data type, cost and performance considerations make this approach undesirable. It is often the case, therefore, that the design of such terminals embodies only one high speed intelligent display adapter (display processing unit) which handles all data types.

Furthermore, it is quite common in applications of such a terminal that although alphanumerics and graphics data appear together in the same picture, the two data types are attached to quite different and asynchronous pieces of host programming. It is clearly undesirable, for example, for a program displaying a drawing of a turbine to need to be aware of the existence of another program whose function is to remind the operator that printer paper needs replenishing. If such programs are to be able to operate autonomously they must be able to add, modify or delete any of their display content without cognizance of other display matter occupying the same screen.

One way to achieve this would be to provide an entirely separate set of bit planes for each data type. This gives the effect of separately visible "layers" on the screen, each layer being capable of independent operation and the sum of the layers being the picture visible to the operator.

In a terminal with multiple colors or multiple grey scale levels this is an expensive technique, since a complete set of bit planes must be provided for each layer required. Thus, for a terminal capable of showing 16 colors or grey levels, four bit planes would be needed for each layer.

U.S. Pat. No. 4,206,457 discloses a non-layered raster scan display system in which high resolution luminance data (i.e. data which simply defines whether a pel is on or off relative to the background irrespective of the color of either) is stored in a first memory, and foreground color information associated with the luminance information is stored to a lower resolution in a much smaller auxiliary memory. In particular, each storage location of the auxiliary memory defines the foreground color of a rectangular array or block of pels on the screen.

However, a significant disadvantage of this system is that, due to its small size, the auxiliary memory is permanently dedicated to the storage of the low resolution foreground color information. Another disadvantage is that the auxiliary memory stores only the foreground color of the luminance information, the background color being defined by a separate set of background select switches which do not correlate the background color with the blocks of foreground color. In other words, the background color is not changeable on a block basis as is the foreground color.

SUMMARY OF THE INVENTION

Accordingly, the present invention provides in a graphics display terminal comprising a raster-scan display device and a refresh buffer including a plurality of bit planes each having a respective bit storage location corresponding to each addressible pel position on the screen of the display device, the bit planes being addressed in coordination with the line-by-line scanning of the display device to provide multi-bit per pel output data defining the color and/or intensity of each pel on the screen, a method of storing alphanumeric data which comprises storing in a first bit plane (luminance plane) high resolution luminance data defining alphanumeric characters each as a selection of "on" bits within a respective character box, and storing in at least one further bit plane (attribute plane) low resolution color data which defines at least the color and/or intensity of the foreground and background of the characters.

The invention further provides, in a graphics display terminal of the aforementioned kind, a method of displaying mixed alphanumeric and graphics information comprising storing graphics data in a first set of the bit planes and storing independently generated alphanumeric data in a second set of the bit planes, the second set of bit planes including a first bit plane (luminance plane) storing high resolution luminance data defining alphanumeric characters each as a selection of "on" bits within a respective character box, and at least one further bit plane (attribute plane) storing low resolution color data which defines at least the color and/or intensity of the foreground and background of the characters, the method further comprising decoding the data output from the two sets of bit planes to control the display device such that the display screen simultaneously contains information derived from both sets of bit planes.

It is to be understood that the term "alphanumeric character" is regarded as including special symbols likewise defined as a selection of "on" bits within a character box.

The invention takes advantage of the fact that significant redundancy exists in the depiction of alphanumeric data. Thus, while graphics applications normally require the ability to define the individual color of each pel, for alphanumerics one can usually accept constant background and foreground colors for groups of adjacent pels. Thus a full set of bit planes equal in number to that used for graphics data is not required for alphanumerics, since the color data need only be specified once in coded form for each group of pels, and this will need less storage than that required for individually specifying the color data for each pel.

It is to be understood that the invention is not limited to only two layers which use one set of bit planes for graphics and a second set for alphanumerics. Provided that there are enough bit planes in the terminal there may be several alphanumeric and graphics layers present at any one time.

Preferably, the luminance plane defines the alphanumeric characters each as a selection of "on" bits within a respective n×m character box where n is the width of the character box in the scan line direction, and wherein the or each attribute plane comprises a respective n-bit set of storage locations which corresponds to each n-bit wide by one pel deep portion of a character box in the luminance plane and defines at least the color and/or intensity of the foreground and background of the character for the width of the character box in respect of a single scan line.

The invention is also not limited to the use of a single attribute plane. For example, if in the preferred embodiment referred to in the preceding paragraph a large number of foreground and background colors are to be defined for each character, it may not be possible to accommodate the necessary number of bits in a single n-bit set of locations in a single bit plane. In this case one attribute plane could define the foreground color (i.e. the color of the "on" bits) and another could define the background color. The attribute plane may also define non-color attributes such as highlighting and blinking, and again more than one attribute plane may be required for this purpose.

On the other hand, it is not necessary that the entire n-bit set of locations in the attribute plane(s), corresponding to each n-bit wide portion of an alphanumeric character, be used if the required foreground/background attributes can be adequately defined in less bits. It is further to be understood that the width of the character boxes need not be the same for all characters.

The invention provides a significant advantage over the aforementioned U.S. Pat. No. 4,206,457 in that by using bit plane(s) for storing both the foreground and background color information, rather than a smaller auxiliary memory for the foreground color and separate select switches for the background color, the assignment of available memory to particular functions need not be constrained; that is, the invention permits bit planes to be assigned by software to whatever purpose is required by the current application set. For example, alphanumeric layers can be traded off against additional colors in the graphics layers or for double buffering, and vice versa. The technique of using a smaller auxiliary foreground color memory and background color select switches would not permit this flexibility in a layered system. Furthermore, the invention permits both the foreground and background colors to be independently changed in respect of different areas of the alphanumeric display.

To exploit the above flexibility, the invention further provides a graphics display terminal of the aforementioned kind which includes a decoder selectively operable in at least two modes, the decoder being operable in a first mode to decode the data content of a first bit plane as high resolution luminance data defining alphanumeric characters each as a section of "on" bits within a respective character box, and to decode the data content of at least one further bit plane as low resolution color data which defines at least the color and/or intensity of the foreground and background of the characters defined by the first bit plane, the decoder further being operable in a second mode to decode the data content of each of the first and further planes as bits which individually map to respective pel positions on the display screen such that bits in each of the first and further bit planes which map to the same pel position together define at least in part the color and/or intensity of the respective pel.

Where the alphanumeric characters are stored in the preferred method referred to above, a further substantial advantage is provided over the above prior art. This is that the attribute plane permits individual color control of each scan line of a character, so that hues produced by visual averaging can be provided within a character box by defining different foreground and/or background colors alternately for each line. For example, assuming that the display device is a CRT with red, blue and green guns, not only can one produce any one of the eight possible combinations of these three colors (red, blue, green, cyan, magenta and yellow) but also further colors which are a mixture of these. Thus orange can be produced by providing red and yellow alternatively on consecutive lines. This is clearly not possible with block-defined color as described in U.S. Pat. No. 4,206,457.

Figure 2:
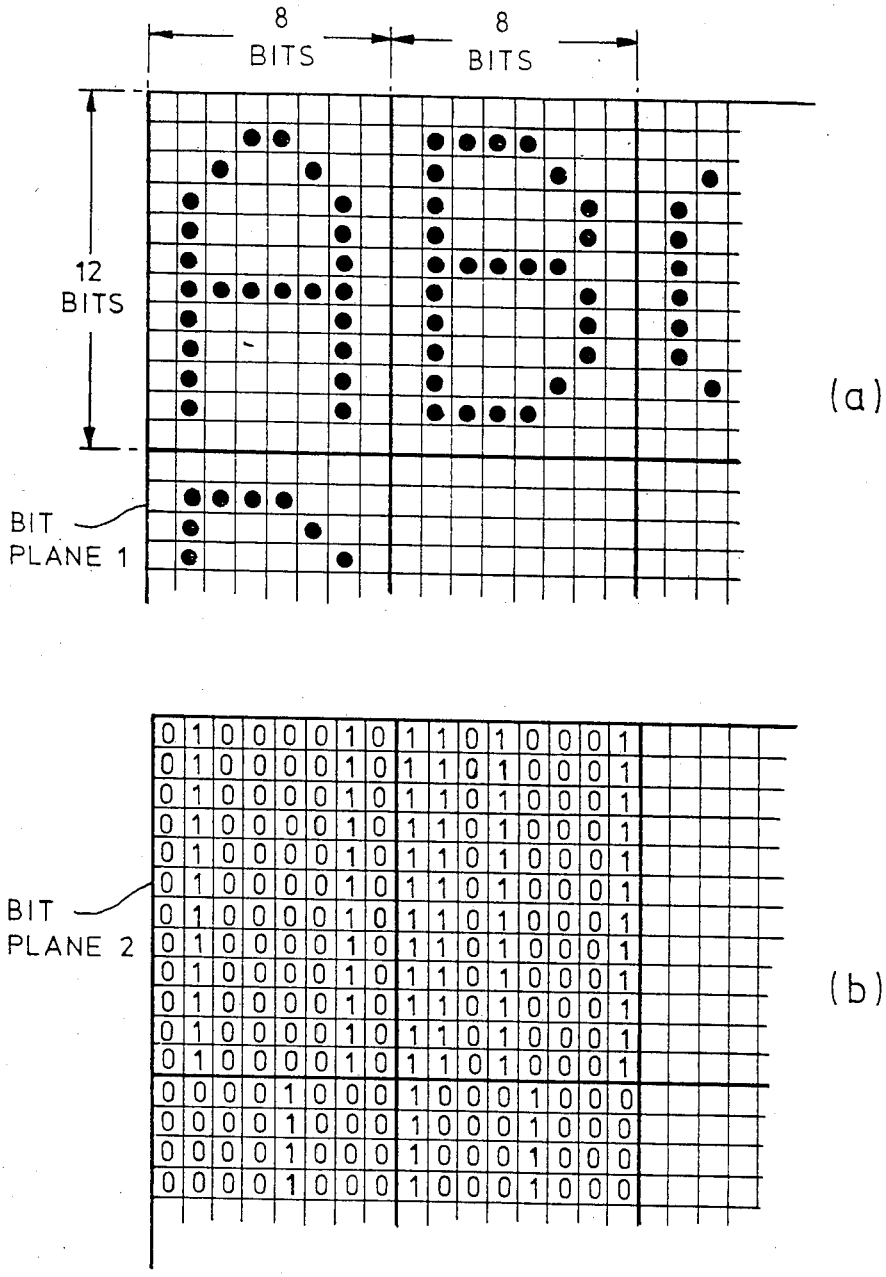
Figure 4:
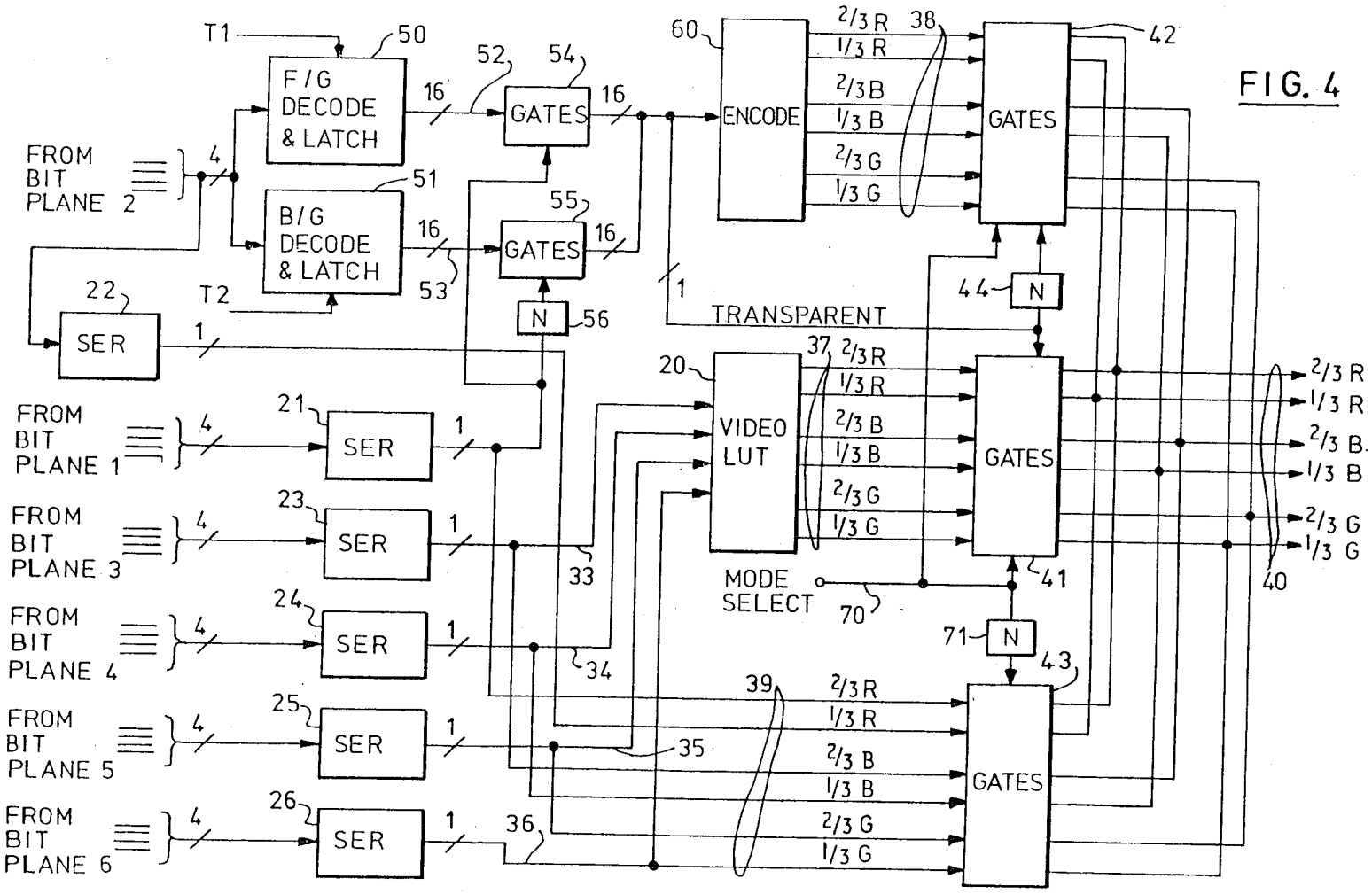

An embodiment of the present invention will now be described, by way of example, with reference to the accompanying drawings, in which:

FIG. 1 is a block schematic diagram of a graphics terminal in which the method of the invention may be performed, FIG. 2 illustrates in schematic form how alphanumeric characters may be coded and stored in the terminal of FIG. 1, FIG. 3 is a table showing the foreground/background color coding scheme used in FIG. 2, and FIG. 4 is a block diagram of the decoder and serialiser of the terminal of FIG. 1.

In FIG. 1 a graphics display terminal attached to a remote host 10 comprises a display processing unit (DPU) 11 which communicates with the host in generally conventional manner via a shared store 12 and generally coordinates the operations of the terminal. Attached to the DPU bus 13 are a bit plane update controller 14 which operates under control of the DPU 11 for changing the information content of bit planes 1 to 6 via update path 15, and a video refresh controller 16 which provides bit plane addressing for display refresh via path 17 and sync signals to a raster scan color CRT (not shown). These components of a raster graphics display terminal and the general functions performed thereby are well known.

The above terminal is capable of two modes of operation; a first mode in which two independent "layers" of information are to be displayed simultaneously on the screen, a graphics layer and an alphanumeric layer, and a second mode in which all six bit planes are used for a single graphics layer. The second mode of operation is conventional and will be dealt with later.

For the first mode the data for the alphanumeric and graphics layers are supplied by the host 10 and inserted in the shared store 12. The data for the graphics layer is in the form of a conventional display list consisting of graphic orders to draw arcs, lines, etc. The graphics data may include alphanumeric characters as part of the data, for example as legends on graphs, but it is not independent of such data. The data for the separate alphanumeric layer, which is independently generated by the host 10, is held in a separate part of the store 12, for example in the form of a character mapped screen buffer containing character codes and attributes.

The DPU 11 multi-tasks between the independent graphics and alphanumeric data held in the store 12, instructing the controller 14 to generate the required bit patterns in the bit planes 1 to 6. The graphics display list is processed in generally conventional manner using suitable vector-to-raster techniques, and the resultant bit information inserted in the bit planes 3 to 6, typically one byte at a time into each bit plane. The bit planes 1 to 6 are physically identical and each has a respective bit storage location corresponding to a unique addressible pel position on the screen of the CRT. In the case of the graphics data, each combination of four bits in corresponding locations in the four bit planes 3 to 6 define the color and intensity of an individual pel on the screen. In the present case, since there are four bit planes for the graphics data, any one of sixteen colors may be defined individually for each pel in the graphics layer.

The alphanumeric data is processed differently, however. The DPU 11 takes each character code in turn and, according to the code, accesses a particular location in a font which is held in the store 12. The accessed location contains a vector definition of the character shape, and this is passed together with the attribute information to the controller 14. The latter rasters the shape information and inserts it byte-by-byte into the bit plane 1. This is shown schematically in FIG. 2(*a*).

In FIG. 2(*a*), each square represents a single bit storage location in bit plane 1 which maps to a respective addressible pel position on the CRT screen. To facilitate understanding, it is assumed that each row and column of bit storage locations corresponds to a respective row and column of pel positions on the screen, with the row direction corresponding to the scan line direction of the CRT display device. However, such physical correspondence is not strictly necessary since the bit planes are random access semiconductor memories.

Each character is entered into bit plane 1 as a selection of "on" bits within an 8 wide by 12 high character box, the box being located in the bit plane 1 at the storage locations corresponding to the desired location of that character on the screen. The character boxes are indicated by heavy lines in FIG. 2(*a*) although it is to be understood that the boundaries of the boxes are not visible except where the background color of adjacent boxes differs. Each byte of data read into the bit plane 1 defines an 8-pel wide by one pel high character slice orientated in the scan line direction, the "on" bits within each slice determining which of the corresponding pels in the display will be visible against the background. In FIG. 2(*a*) the "on" (foreground) pels are represented by dots within the storage locations and the "off" (background) pels are represented by the absence of dots. The "on" pels may be represented by binary 1's and the "off" pels by binary 0's. It will be noted that the data in the bit plane 1 defines only luminance information, i.e. whether a pel is "on" relative to the background, but does not define the color of the foreground or background or any other attribute associated with the character.

It is to be understood that the font contained in the store 12 could alternatively define the character shapes directly in 8 by 12 dot matrix form, so that these can be read out to bit plane 1 slice-by-slice without rastering.

During update of bit plane 1 with character luminance information, the controller 14 enters corresponding color and other attribute data byte-by-byte into bit plane 2. This is shown schematically in figure 2(*b*), where each 8 by 12 set of storage locations corresponding to a character box in FIG. 2(*a*) is indicated in heavy lines. Each 8-bit slice of a notional character box in FIG. 2(*b*) defines, not the color of individual pels represented by the correspondingly positioned 8-bit slice in FIG. 2(*a*), but the foreground and background colors for the entire 8-bit character slice.

In any given 8-bit slice in FIG. 2(*b*) the first four bits define the foreground color and the last four bits define the background color for the correspondingly positioned character slice in FIG. 2(*a*). The four bits code the desired color according to the table of FIG. 3, and it will be seen by inspection of FIG. 2(*b*) that, in FIG. 2(*a*), the capital A is defined as steady red on a steady blue background, the capital B as blinking (flashing) yellow on a steady green background, and the letter immediately below the A is shown as black on a transparent background. Although the table of FIG. 3 defines only eight colors, including black and white, other colors can be produced by defining alternate foreground and/or background colors for consecutive line slices within a character box, as mentioned above.

As will be described, the alphanumeric layer defined by the luminance and attribute planes 1 and 2 respectively takes priority over the graphics layer defined by bit planes 3 to 6, and the control is effected using the transparent attribute. Thus a transparent foreground or background permits the graphics layer to show through the foreground or background of the character respectively, while a character box having no visible foreground bits and a transparent background (such as the box immediately below the capital B) will permit the graphics layer to show through the entire character box. It is to be noted that the last mentioned character box is also defined as having a transparent foreground but this is not strictly necessary as no visible foreground has been defined in FIG. 2(*a*). Where a space between characters is to be provided, but the graphics layer is not to show through, the corresponding character box in FIG. 2(*a*) would define no visible foreground pels and the corresponding box in FIG. 2 (*b*) would define the background as some non-transparent color.

During display refresh under control of the controller 16, the contents of all bit planes 1 to 6 are read out cyclically and in synchronism, typically a byte or half-word (two bytes) at a time, starting at the upper left storage location of each bit plane and scanning row-by-row down through the bit planes in coordination with the line-by-line scanning of the CRT. It is to be recognised that such output data requires to be serialised for use by the CRT, and this is primarily the function of the decoder/serialiser to be described. However, in the present case it is assumed that the bit planes include means for partially serialising the output data prior to placing this on the refresh path 18. In particular, it is assumed that the output to the refresh path 18 comprises successive 4-bit wide blocks supplied in parallel at one quarter pel rate from each bit plane to the refresh path which therefore comprises 24 lines.

Each 4-bit block corresponds to four consecutive bit storage locations in the respective bit plane, these being, at any given time, the same four locations in each bit plane. Thus, at any instant the 24 lines of the refresh path 18 carry parallel information relating to four consecutive pels on the display screen. These 24 lines are connected to a decoder/serialiser 19 which is shown in detail in FIG. 4. The operation of the decoder/serialiser 19 for the first (two layer) mode of the terminal will now be described.

On the left of FIG. 4 there are shown the four lines from each bit plane 1 to 6. The data in bit planes 3 to 6 which pertains to the graphics layer is serialised in conventional manner in respective serializers 23 to 26 and the successive combinations of 4 bits, output at pel rate in parallel on lines 33 to 36 respectively, are used to access a video look-up-table (LUT) 20. Each 4-bit combination comprises 1 bit from corresponding locations in each of the bit planes 3 to 6, and maps to a unique pel position on the CRT screen.

It is assumed that each of the red, blue and green electron guns of the CRT may be driven, via a digital-to-analog converter 30 (FIG. 1), at full intensity, ⅔rds intensity, ⅓rd intensity or zero intensity by a suitable combination of binary signals present in parallel on the output lines 40 of the decoder/serializer 19. Thus 64 colors may be defined. However, since only four bits per pel are output from the bit planes 3 to 6, the data in the graphics layer can only define 16 colors. The LUT therefore selects a suitable subset of the total available, these being the first eight shown in the table of FIG. 3 together with additional useful colors such as brown. The contents of the LUT may be changed via the bus 13.

The signals thus provided in parallel on the six output lines 37 of the LUT 20 are applied to a set of gates 41 where they are either passed to the lines 40 or blocked, according to the current transparency attribute of the alphanumeric layer as will be described.

In regard to the data for the alphanumeric layer, successive 4-bit parallel blocks from the attribute bit plane 2 are alternately clocked into foreground and background decoder/latch circuits 50 and 51 respectively by clock signals T1 and T2. The clock signals occur at 8-pel intervals and are 180° out of phase. Each circuit 50 and 51 decodes the respective foreground or background color according to the table of FIG. 3, and provides an output on one of sixteen output lines 52 and 53, each line corresponding to one of the decoded colors. The decoded foreground and background colors are latched at the outputs of the circuits 50 and 51 for eight pel periods; i.e. for the duration of an entire 8-bit wide slice of luminance data from the bit plane 1.

Meanwhile, the data from the luminance bit plane 1 is serialized in serialiser 21 and the output thereof controls respective foreground and background gates 54 and 55, in the former case directly and in the latter case via an inverter 56. It is to be understood that the timing of the decoder/serialiser 19 is adjusted, by means of selective delays (not shown), such that during each 8-bit wide character slice output in serial form from the serializer 21 the foreground and background attributes for that character slice are available at the outputs 52 and 53. This is clearly necessary, since without such timing adjustments the background information for each character slice would not be available until the fifth bit of luminance information. If desired, part of the timing adjustment could be achieved by addressing the attribute bit plane ahead of the luminance bit plane, or by storing the attribute information offset in the bit plane 2 relative to the position of the corresponding luminance information in the bit plane 1. Essentially, the requirement is to delay the foreground and luminance information by about 4 pel periods relative to the background information, and it is to be noted that the same delay must be applied to the graphics data from bit planes 3 to 6 to ensure that the data ultimately output at 40 corresponds to the same screen pel irrespective of source.

The function of the gates 54 and 55 is to pass the 1-of-16 signal 52 defining the foreground color to an encoder 60 in respect of each foreground bit from the serialiser 21, and to pass the 1-of-16 signal 53 defining the background color to the encoder in respect of each background bit. Thus gate 54 is enabled by each foreground bit, and gate 55 by each background bit.

The encoder 60 generates the appropriate combination of signals on its outputs 38, and these are either passed by gates 42 to the output lines 40 or not according to the transparency attribute. A transparent foreground or background pel will give an output on a particular one of the sixteen lines to the encoder 60, and this line is used as a control to determine which of the gates 41 and 42 will be open in respect of any given pel. When the color attribute is non-transparent gate 42 is enabled via the inverter 44, whereas when it is transparent gate 41 is enabled. Thus, the transparency attribute controls whether it is the alphanumeric layer from bit planes 1 and 2 which is visible or the graphics layer from bit planes 3 to 6. It is to be noted that blinking can be accomplished by intermittently forcing the transparency attribute at, say, half second intervals.

This completes the description of the first mode of operation of the terminal. In the second mode of operation, in which all six bit planes are used for a single graphics layer, the bit planes are loaded as before by the bit plane update controller 14 in accordance with a display list in the store 12, except that in this case each screen pel is defined by a respective combination of six bits in corresponding storage locations in the six bit planes 1 to 6. During video refresh, however, and in contrast to the first mode of operation, all bit planes are treated the same by the decoder/serialiser 19. A '0' signal on a mode select line 70 blocks gates 41 and 42 and, via an inverter 71, enables a set of gates 43 (it is to be noted that during the first mode described earlier the mode select signal is a '1' which enables gates 41 and 42 while blocking gates 43). The mode select signal is supplied by the bus 13, FIG. 1. The output from bit plane 2 is serialised in a serialiser 22, in a similar manner to the serialisation of the outputs from the bit planes 1 and 3 to 6.

Since there are, in this second mode, six bits defining each pel (i.e. mapping to the same pel position on the CRT screen), the six intensity signals on the output lines 40 can be directly defined without the use of a look-up-table, giving the full range of 64 colors. Thus, the output of each serialiser 21 to 26 is applied to a respective input of the gates 43. Since these gates 43 are enabled by the mode select signal, the signals from the serializers pass through to the digital-to-analog converter 30 (FIG. 1).

It is to be understood that the invention is not limited to the specific arrangement described above. The terminal may include further bit planes to permit more than two independent layers to be handled, including an image layer in which non-coded pel data is supplied directly from the host 10. Even given the restriction to six bit planes, by suitable design of the decoder the invention permits these to be flexibly assigned to whatever purpose is currently required. For example, they could be divided into three alphanumeric layers, three two-bit graphics layers, or any combination of these. Alternatively, the four bit planes provided for graphics could be used for image data supplied in non-coded form. These assignments are all made possible by the method of the invention which uses a bit plane similar to the others, rather than a separate and smaller store, for the storage of low resolution color information.

We claim:

1. In a graphics display terminal of the kind comprising a display device having a raster-scanned screen and a refresh buffer including a plurality of bit planes each having a respective bit storage location corresponding to an associated addressable pel position on said screen, the bit plane being addressed in coordination with the line-by-line scanning of the display device to provide multi-bit per pel output data defining the color and/or intensity of each pel on the screen, the improvement comprising a decoder selectively operable in at least two modes, the decoder being operable in a first mode to decode the data content of a first bit plane as high resolution luminance data defining alphanumeric characters each as a selection of "on" bits within a respective character box, and to decode the data content of at least one further bit plane as low resolution data the individual units of which correspond to groups of pels and which define at least the color and/or intensity of each of the foreground and background of the characters defined by the first bit plane, the decoder further being operable in a second mode to decode the data content of each of the first and further planes as bits which individually map to respective pel positions on the display screen such that bits in each of the first and further bit planes which map to the same pel position together define at least in part the color and/or intensity of the respective pel wherein the terminal includes additional bit planes as well as the first and further bit planes, and in the second mode the decoder is further operable to decode the data content of each of the additional bit planes as bits which also individually map to respective pel positions on the display screen, those bits in each of the first, further and additional bit planes which map to the same pel position, and in the first mode the decoder is operable to decode the data content of the additional bit planes as bits which individually map to respective pel positions on the display screen such that bits in each of the additional bit planes which map to the same pel position together define the color and/or intensity of the respective pel independently of the data content of the first and further bit planes, the decoder further including means for selectively switching between displaying information derived from the first and further bit planes and displaying information derived from the additional bit planes.

2. A graphics display terminal according to claim 1, wherein in the first mode the first bit plane defines the alphanumeric characters each as a selection of "on" bits within a respective $n \times m$ character box where n is the width of the character box in the scan line direction, and the or each further bit plane comprises a respective pair of n/2-bit sets of storage locations which corresponds to each n-bit wide by one pel deep portion of a character box in the first bit plane and collectively define at least the color and/or intensity of the foreground and background of the character for the width of the character box in respect of a single scan line through n pels of said character box.

3. A graphics display terminal according to claim 1, wherein the further bit plane defines the foreground or background of at least one character box as transparent, and wherein the information derived from the additional bit plane is only visible in respect of parts of the screen having a transparent attribute.

* * * * *